US010320057B2

(12) United States Patent
Miura

(10) Patent No.: US 10,320,057 B2
(45) Date of Patent: Jun. 11, 2019

(54) ANTENNA DEVICE, WIRELESS COMMUNICATION DEVICE, AND BAND ADJUSTMENT METHOD

(71) Applicant: NEC Platforms, Ltd., Kawasaki-shi, Kanagawa (JP)

(72) Inventor: Ken Miura, Kanagawa (JP)

(73) Assignee: NEC PLATFORMS, LTD., Kanagawa (JP)

( * ) Notice: Subject to any disclaimer, the term of this patent is extended or adjusted under 35 U.S.C. 154(b) by 44 days.

(21) Appl. No.: 15/314,012

(22) PCT Filed: Jun. 11, 2015

(86) PCT No.: PCT/JP2015/002929
§ 371 (c)(1),
(2) Date: Nov. 25, 2016

(87) PCT Pub. No.: WO2015/198549
PCT Pub. Date: Dec. 30, 2015

(65) Prior Publication Data

US 2017/0201007 A1 Jul. 13, 2017

(30) Foreign Application Priority Data

Jun. 26, 2014 (JP) ..... 2014-131195

(51) Int. Cl.
*H01Q 1/24* (2006.01)
*H01Q 9/14* (2006.01)
(Continued)

(52) U.S. Cl.
CPC ..... *H01Q 1/24* (2013.01); *H01Q 1/243* (2013.01); *H01Q 1/38* (2013.01); *H01Q 1/48* (2013.01);
(Continued)

(58) Field of Classification Search
CPC ..... H01Q 5/378
See application file for complete search history.

(56) References Cited

U.S. PATENT DOCUMENTS 6,147,651 A 11/2000 Yamazaki et al.
7,528,783 B2 5/2009 Takagi
(Continued)

FOREIGN PATENT DOCUMENTS

CN 102763398 A 10/2012
CN 202759016 U 2/2013
(Continued)

OTHER PUBLICATIONS

International Search Report for PCT Application No. PCT/JP2015/002929, dated Sep. 1, 2015.
(Continued)

*Primary Examiner* — Graham P Smith

(57) ABSTRACT

In order to provide an antenna technology capable of easily achieving, with a simple structure, a wide bandwidth in which wireless communication can be performed, an antenna device is provided with a feed antenna element, and a parasitic antenna element. The feed antenna element is provided on a circuit board, and is electrically coupled to a power supply that is provided on the circuit board. The parasitic antenna element is electrically coupled to the feed antenna element. The parasitic antenna element has a grounding portion. The grounding portion is electrically coupled to a ground layer via an inductive element, said ground layer being formed on the circuit board and having a reference potential.

5 Claims, 13 Drawing Sheets

(51) Int. Cl.

| | |
|---|---|
| ***H01Q 9/42*** | (2006.01) |
| ***H01Q 1/38*** | (2006.01) |
| ***H01Q 1/48*** | (2006.01) |
| ***H01Q 5/378*** | (2015.01) |

(52) U.S. Cl.
CPC ..... *H01Q 5/378* (2015.01); *H01Q 9/14* (2013.01); *H01Q 9/42* (2013.01)

(56) References Cited

U.S. PATENT DOCUMENTS

| | | | | |
|---|---|---|---|---|
| 7,675,469 | B2 | 3/2010 | Ohba et al. | |
| 7,825,861 | B2 | 11/2010 | Sato et al. | |
| 9,054,413 | B2 | 6/2015 | Yuasa et al. | |
| 9,391,358 | B2 | 7/2016 | Yanagi et al. | |
| 2008/0007468 | A1 | 1/2008 | Sato et al. | |
| 2008/0169984 | A1 | 7/2008 | Takagi | |
| 2008/0266190 | A1* | 10/2008 | Ohba ..... | H01Q 1/243 343/702 |
| 2010/0164812 | A1 | 7/2010 | Ganeshan et al. | |
| 2011/0128193 | A1 | 6/2011 | Arimura et al. | |
| 2012/0249386 | A1 | 10/2012 | Yanagi et al. | |
| 2013/0002510 | A1 | 1/2013 | Azulay et al. | |
| 2013/0257661 | A1 | 10/2013 | Yuasa et al. | |
| 2014/0111386 | A1 | 4/2014 | Xu | |
| 2016/0301137 | A1 | 10/2016 | Yanagi et al. | |

FOREIGN PATENT DOCUMENTS

| | | | |
|---|---|---|---|
| CN | 103403962 | A | 11/2013 |
| JP | 2008-017352 | A | 1/2008 |
| JP | 2008-172672 | A | 7/2008 |
| JP | 2008-278219 | A | 11/2008 |
| JP | 2011-119949 | A | 6/2011 |
| JP | 2012-209752 | A | 10/2012 |
| JP | 2013-211657 | A | 10/2013 |
| WO | 98/11625 | A1 | 3/1998 |
| WO | 2005/029638 | A1 | 3/2005 |
| WO | 2009/147885 | A1 | 12/2009 |
| WO | 2011/101851 | A1 | 8/2011 |

OTHER PUBLICATIONS

English translation of Written opinion for PCT Application No. PCT/JP2015/002929.
Japanese Office Action for JP Application No. 2014-131195 dated Jul. 31, 2018 with English Translation.
Chinese Office Action for CN Application No. 201580032863.X dated Oct. 8, 2018 with English Translation.

* cited by examiner

ANTENNA DEVICE, WIRELESS COMMUNICATION DEVICE, AND BAND ADJUSTMENT METHOD

This application is a National Stage Entry of PCT/JP2015/002929 filed on Jun. 11, 2015, which claims priority from Japanese Patent Application 2014-131195 filed on Jun. 26, 2014, the contents of all of which are incorporated herein by reference, in their entirety.

TECHNICAL FIELD

The present invention relates to a technology to realize an antenna included in a communication device which performs wireless communication.

BACKGROUND ART

In recent years, a mobile communication device such as a portable telephone, a portable router, or the like has been downsized. And according to downsizing of the mobile communication device, a built-in antenna used for the mobile communication device is also downsized. Due to downsizing the antenna, it is difficult to realize an antenna with good communication performance. Namely, in order to transmit and receive a radio wave with a frequency allocated for wireless communication, the electrical length of the antenna has to match the wavelength of the radio wave with the frequency allocated for wireless communication. However, in case of downsizing the antenna, it is difficult to get the required electrical length. In particular, in case of further downsizing the antenna, it is difficult for the antenna to perform good communication by using a radio wave with low bandwidth whose wavelength is large. Therefore, the antenna has a problem in which it is difficult to downsize the antenna while maintaining communication performance.

In patent literature 1 (WO2005/029638 A1), there is described a structure in which a feed antenna is configured on a first circuit board and a parasitic antenna is configured on a second circuit board. Further, in patent literature 1, there is described a structure in which the parasitic antenna is coupled to a GND (Ground) part via a coil.

In patent literature 2 (WO2009/147885 A1), there is described a structure in which in a multi-band antenna including a feed element and a parasitic element, an LC resonant circuit is interposed in each of the feed element and the parasitic element.

In patent literature 3 (JP2011-119949 A), there is described a structure in which a feed antenna element is configured on one surface of a circuit board of which a wireless LAN (Local Area Network) card is formed and a parasitic antenna element is configured on the other surface.

CITATION LIST

Patent Literature

[PTL 1] International Publication No. 2005/029638
[PTL 2] International Publication No. 2009/147885
[PTL 3] Japanese Patent Application Laid-Open No. 2011-119949

SUMMARY OF INVENTION

Technical Problem

Various technologies to downsizing the antenna while maintaining communication performance are proposed.

However, these proposed various technologies have problems: for example, a problem in which the shape of an antenna element becomes complicated, a problem in which it is difficult to be set at the transmission/reception frequency of the antenna, and the like occurs.

The present invention is invented to solve the above-mentioned problems. Then, the main object of the present invention is to provide a technology to realize an antenna which has a simple structure and in which broadband wireless communication can be easily realized.

Solution to Problem

To achieve the main object of the present invention, an antenna device of the present invention includes:

a feed antenna element that is coupled electrically to a power supply source which supplies a signal used in wireless communication; and a parasitic antenna element that is coupled electrically to the feed antenna element, wherein the feed antenna element is configured in a circuit board equipped with the power supply source, and the parasitic antenna element includes a ground part, and the ground part is coupled electrically to a ground layer via an inductive element having inductivity, the ground layer has a reference potential and is formed in the circuit board.

A wireless communication device of the present invention includes:

the antenna device of the present invention;

the power supply source that supplies a signal used in wireless communication; and the circuit board that includes the power supply source.

A bandwidth adjustment method of the present invention includes:

configuring a parasitic antenna element in a circuit board in which a feed antenna element is configured, the feed antenna element being coupled electrically to a power supply source which supplies a signal used in wireless communication, the parasitic antenna element being coupled electrically to the feed antenna element;

electrically connecting a connection part of the parasitic antenna element to a ground layer via an inductive element having inductivity, the ground layer having a reference potential and being formed in the circuit board; and adjusting a bandwidth of wireless communication by resonance of the parasitic antenna element and the feed antenna element by adjusting an inductive reactance of the inductive element.

Advantageous Effects of Invention

By using the present invention, an antenna, which has a simple structure and in which broadband wireless communication can be easily achieved, can be provided without enlarging the device size.

DESCRIPTION OF EMBODIMENTS

Figure 1:
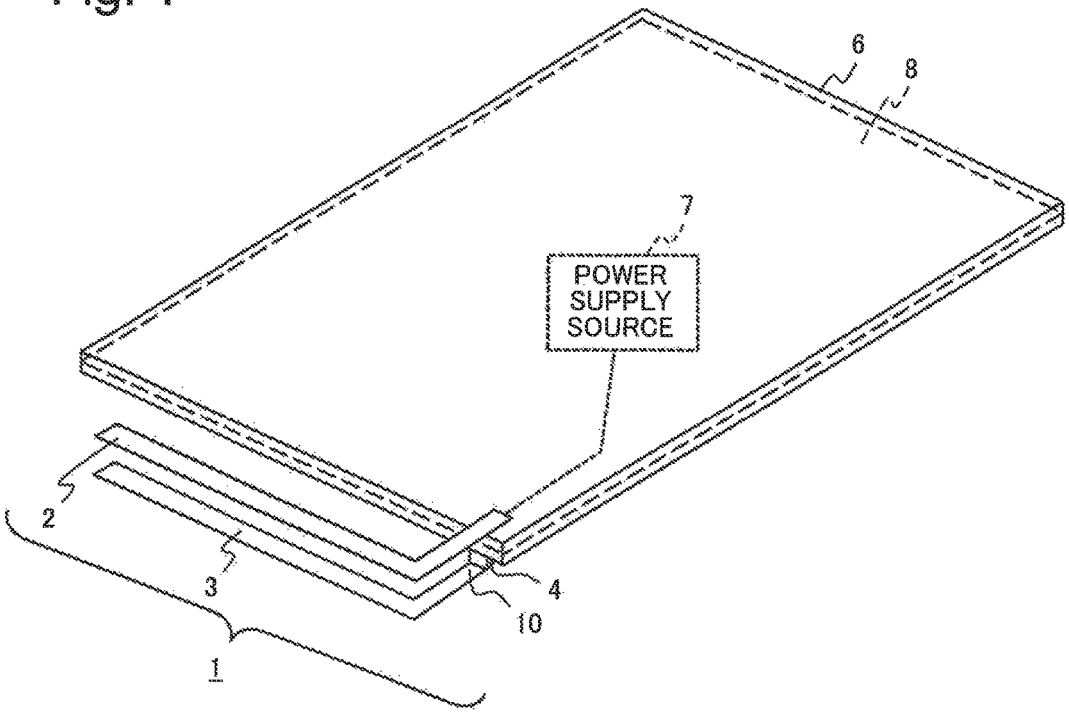
FIG. 1 is a figure illustrating a configuration of an antenna device according to a first example embodiment of the present invention.

An example embodiment of the present invention will be described below with reference to the drawing.

First Example Embodiment

FIG. 1 is a figure explaining an antenna device according to a first example embodiment of the present invention. In FIG. 1, the antenna device 1 according to the first example embodiment is configured on a circuit board 6 of which a wireless communication device is formed. The antenna device 1 according to the first example embodiment includes a feed antenna element 2 and a parasitic antenna element 3. The feed antenna element 2 and the parasitic antenna element 3 are mounted on (coupled to) the circuit board 6 of the wireless communication device. The feed antenna element 2 is electrically coupled to a power supply source 7 formed on the circuit board 6 and signal used in wireless communication is supplied from the power supply source 7 to the feed antenna element 2. The parasitic antenna element 3 is not directly coupled to the power supply source 7. The parasitic antenna element 3 is electrically coupled to the feed antenna element 2 and whereby, the signal is supplied from the feed antenna element 2 to the parasitic antenna element 3. The parasitic antenna element 3 includes a ground part 10. The ground part 10 is electrically coupled to a ground layer 8 included in the circuit board 6 via an inductive element 4 having inductivity.

The ground part 10 of the parasitic antenna element 3 is coupled to the inductive element 4 and whereby, the antenna device 1 according to the first example embodiment can obtain a following effect. Namely, in the antenna device 1 according to the first example embodiment, the inductivity of the inductive element 4 allows to lengthen an electrical length of the parasitic antenna element 3 without changing the physical length of the parasitic antenna element 3. In other words, in the antenna device 1, a resonant frequency of the parasitic antenna element 3 can be adjusted in a lower direction by the inductivity of the inductive element 4. Therefore, by lowering a low frequency limit of the bandwidth of wireless communication realized by resonance of the feed antenna element 2 and the parasitic antenna element 3, the antenna device 1 can widen the bandwidth. Namely, the bandwidth of the antenna device 1 can be easily widened.

Further, in the first example embodiment, the inductive element 4 is installed at a position at which the ground part 10 of the parasitic antenna element 3 is coupled. For this reason, the parasitic antenna element 3 can have a long electrical length even when the inductive element 4 has a small circuit constant (inductive reactance) in comparison with a case in which the inductive element 4 is interposed in for example, a central part or an open end side of the parasitic antenna element 3. In other words, for example, when the inductive element 4 is interposed in the central part of the parasitic antenna element 3, the parasitic antenna element 3 can have the long electrical length only when the inductive element 4 has a large circuit constant unlike a case in which the inductive element 4 is coupled to the ground part 10. When the inductive element 4 has a large circuit constant, the resistance component of the inductive element 4 is large. Accordingly, a problem in which the antenna characteristics are degraded by the resistance component of the inductive element 4 occurs. Further, when the inductive element 4 has a large circuit constant, it causes inconvenience that a position in which the inductive element 4 of the parasitic antenna element 3 is interposed is regarded as an open end. In the antenna device 1 according to the first example embodiment, by connecting the inductive element 4 to the ground part 10 of the parasitic antenna element 3, occurrence of such problem can be prevented and the electrical length of the parasitic antenna element 3 can be made long.

Therefore, the antenna device 1 according to the first example embodiment can obtain following effects. That is, according to the antenna device 1, an antenna, which has a simple structure and in which broadband wireless communication can be easily achieved, can be provided without enlarging the device size. Further, the antenna device 1 according to the first example embodiment can be downsized by adjusting the inductivity of the inductive element 4.

Figure 2:
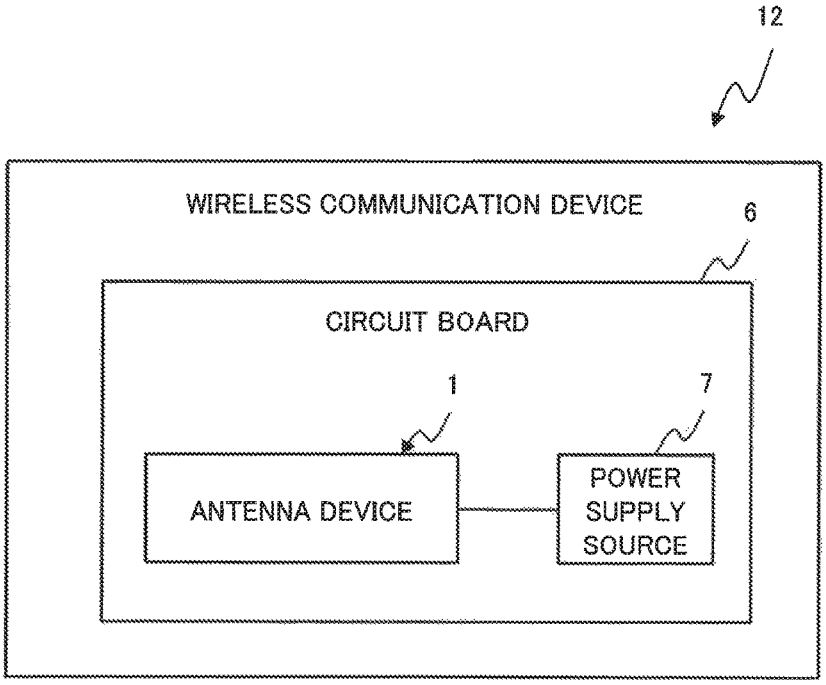
FIG. 2 is a block diagram showing simply a wireless communication device including an antenna device shown in FIG. 1.

As shown in FIG. 2, a wireless communication device 12 includes the antenna device 1 according to the first example embodiment and the circuit board 6 equipping the power supply source 7. Because the wireless communication device 12 includes the antenna device 1, the wireless communication device 12 can be downsized by downsizing the antenna device 1.

Second Example Embodiment

A second example embodiment according to the present invention will be described below.

Figure 3:
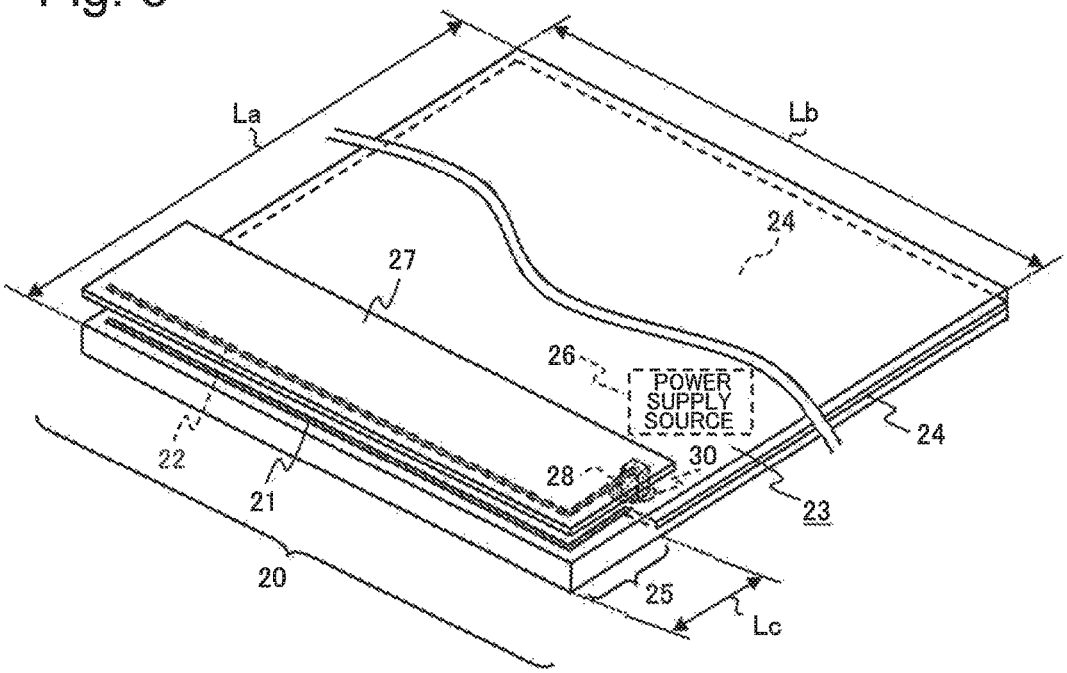
FIG. 3 is a figure illustrating a configuration of an antenna device according to a second example embodiment of the present invention.

FIG. 3 is a figure illustrating a configuration of an antenna device according to the second example embodiment. The antenna device 20 according to the second example embodiment is an antenna device which is mounted on (coupled to) a circuit board 23 of a wireless communication device (for example, a portable telephone or a portable router) and of which the wireless communication device is composed. The antenna device 20 includes a feed antenna element 21 and a parasitic antenna element 22.

The feed antenna element 21 is an antenna element electrically coupled to a power supply source 26 equipped on the circuit board 23. Signal used in wireless communication is supplied from the power supply source 26 to the feed antenna element 21. In this second example embodiment, the feed antenna element 21 is configured with a conductive pattern formed on the board surface of the circuit board 23. In this second example embodiment, a part of the circuit board 23 on which the feed antenna element (conductive pattern) 21 is formed is a non-ground area. Namely, the circuit board 23 is a multilayer board in which a plurality of layers are laminated and the circuit board 23 includes a ground layer 24 with reference potential. In this second example embodiment, a non-ground area 25 in which the ground layer 24 is not formed is set at an end edge side of the circuit board 23. A conductive pattern which functions as the feed antenna element 21 is formed on the board surface in this non-ground area 25. This conductive pattern is L-shaped. Further, the shape of the conductive pattern (the feed antenna element 21) is not limited to the L-shape and a shape (for example, a meander shape or the like) other than the L-shape may be used. In this example embodiment, a simple shape is used to avoid a complicated shape.

The length from an end part of a power supply side coupled to the power supply source 26 to the open end in the feed antenna element 21 is set as follows. Namely, the length of the feed antenna element 21 is set such that the feed antenna element 21 has the electrical length which can resonate at a frequency in the bandwidth of a radio wave set for wireless communication performed by the antenna device 20.

The parasitic antenna element 22 has a configuration in which the parasitic antenna element 22 is electrically coupled to the feed antenna element 21 and whereby, the signal used in wireless communication is supplied from the feed antenna element 21 to the parasitic antenna element 22. Namely, the parasitic antenna element 22 and the feed antenna element 21 are arranged in parallel via a distance in a thickness direction which is along with thickness of the circuit board 23. In this second example embodiment, a dielectric substrate 27 is arranged separately from the non-ground area 25 of the circuit board 23 in parallel. The conductive pattern which functions as the parasitic antenna element 22 is formed on the board surface (in FIG. 3, the rear surface) of the dielectric substrate 27 so as to face the feed antenna element 21. The shape and the size of this parasitic antenna element (conductive pattern) 22 are the same or approximately the same as those of the feed antenna element 21.

One end side (in other words, a part that faces the end part of the power supply side of the feed antenna element 21) of the parasitic antenna element 22 functions as a ground part 28. The ground part 28 of this parasitic antenna element 22 is coupled to a coil 30 formed on the circuit board 23 and electrically coupled to the ground layer 24 via the coil 30. The coil 30 is an inductive element having inductivity and has a circuit constant (inductance) adjusted so as to satisfy antenna characteristics required for the antenna device 20 that are determined by the specification or the like.

Namely, the physical length of the parasitic antenna element 22 is equal to that of the feed antenna element 21. However, since the parasitic antenna element 22 is coupled to the coil 30, the electrical length of the parasitic antenna element 22 can have the electrical length longer than that of the feed antenna element 21. Accordingly, the parasitic antenna element 22 has the resonant frequency lower than that of the feed antenna element 21 and whereby, widening the bandwidth of a radio wave used in wireless communication by the antenna device 20 can be achieved. Namely, by adjusting the inductance of the coil 30, the wireless communication bandwidth of the antenna device 20 can be variably adjusted. Further, by adjusting the inductance of the coil 30, antenna characteristics (for example, return-loss characteristics and radiation efficiency characteristics) other than the wireless communication bandwidth of the antenna device 20 can also be variably adjusted. Therefore, the inductance of the coil 30 is set such that the antenna device 20 can satisfy the required antenna characteristics.

Figure 7:
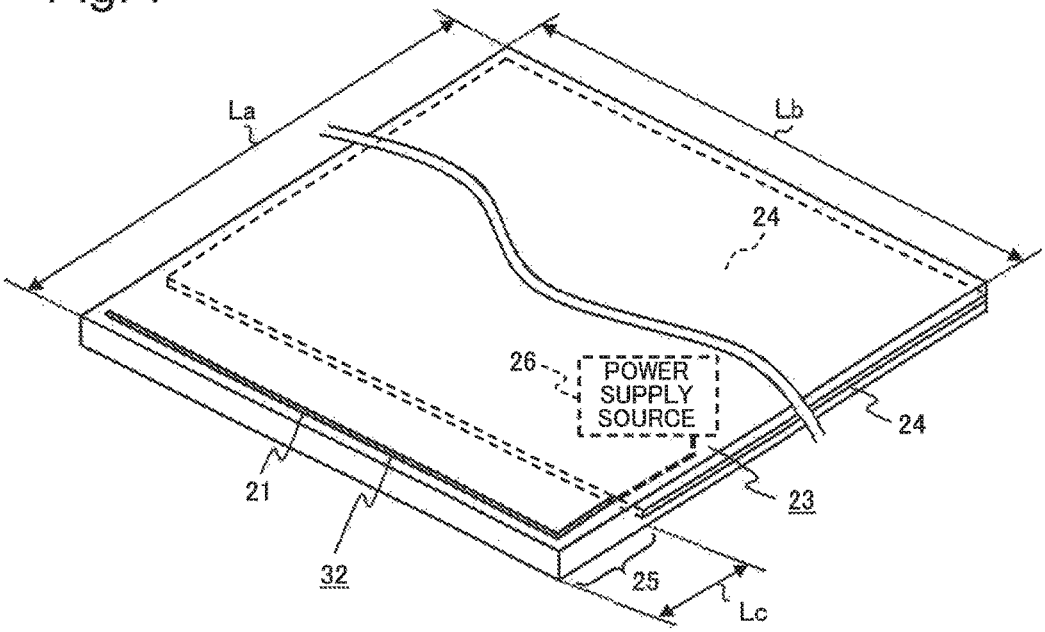
FIG. 7 is a figure illustrating a configuration of an antenna device of a comparison example.

The antenna device 20 according to the second example embodiment has a configuration mentioned above. As a result, the antenna device 20 according to the second example embodiment can obtain the following effects. Namely, the antenna device 20 according to the second example embodiment can obtain effects in which the antenna, which has a simple structure and in which broadband wireless communication can be easily achieved, can be provided without enlarging the device size. The inventor confirmed these effects through experiments. In the experiments, the antenna device 20 for transmitting and receiving a radio wave of 700 MHz band and 800 MHz band was produced. The impedance (input impedance) when the feed antenna element 21 and the parasitic antenna element 22 are viewed from the power supply end part (the end part coupled to the power supply source 26) of the feed antenna element 21 of the antenna device 20 is calculated by the simulation. Further, return-loss characteristics and radiation efficiency characteristics of the antenna device 20 are also calculated by the simulation. Further, an input impedance, return-loss characteristics, and radiation efficiency characteristics of an antenna device of a comparison example are also calculated by the simulation for the comparison between the antenna device 20 and the antenna device of the comparison example. As shown in FIG. 7, the antenna device of the comparison example has a configuration similar to that of the antenna device 20. However, the parasitic antenna element 22 including the coil 30 is not assembled in the antenna device of the comparison example. This is a difference between the antenna device of the comparison example and the antenna device 20.

In this experiment, a length La of a long side of the circuit board 23 on which the antenna device 20 (the antenna device 32 of the comparison example) according to the second example embodiment is mounted is 97.5 mm and a length Lb of a short side of the circuit board 23 is 54 mm. Further, the width Lc of the non-ground area 25 in the circuit board 23 is 10.5 mm. Furthermore, a distance between the feed antenna element 21 and the parasitic antenna element 22 is 4 mm. In this experiment, the inductance of the coil 30 is 24 nH (nanohenry).

Figure 4:
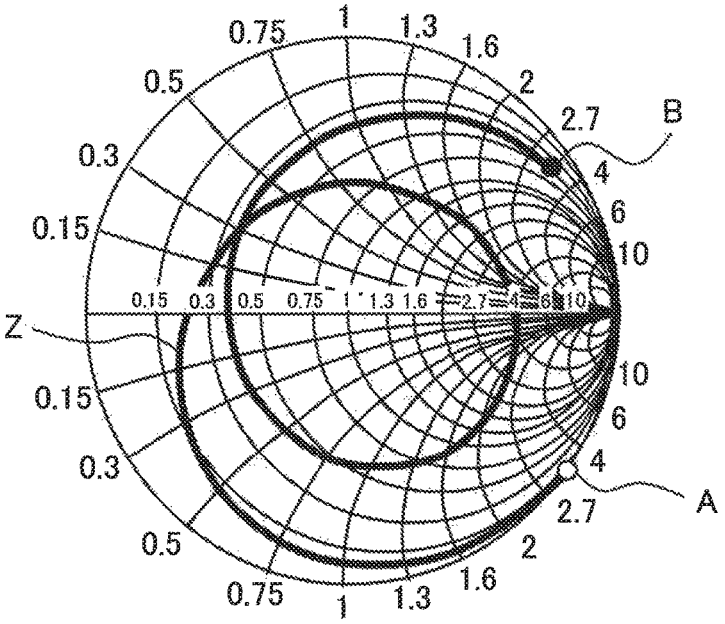
FIG. 4 is a Smith chart showing impedance characteristics obtained by experiment concerning the antenna device shown in FIG. 3.

FIG. 4 is a Smith chart showing impedance characteristics of the antenna device 20 according to the second example embodiment. In other words, FIG. 4 is a Smith chart showing the input impedance versus frequency of the antenna device 20 on which the input impedance of the power supply end part of the feed antenna element 21 of the antenna device 20 according to the second example embodiment is plotted versus the frequency of the signal supplied from the power supply source 26 to the feed antenna element 21 as a solid line Z. In FIG. 4, the input impedance at the point of one end side A on the solid line Z is an input impedance when the frequency of the signal from the power supply source 26 is 500 MHz (Megahertz). The point of one end side A on the solid line Z corresponds to the lowest frequency of the signal. In contrast, the input impedance at the point of other end side B on the solid line Z is an input impedance when the frequency of the signal from the power supply source 26 is 1200 MHz. The point of the other end side B on the solid line Z corresponds to the highest frequency of the signal. Therefore, each point on the solid line Z between the one end side A and the other end side B corresponds to each frequency between the lowest and highest frequencies.

Figure 5:
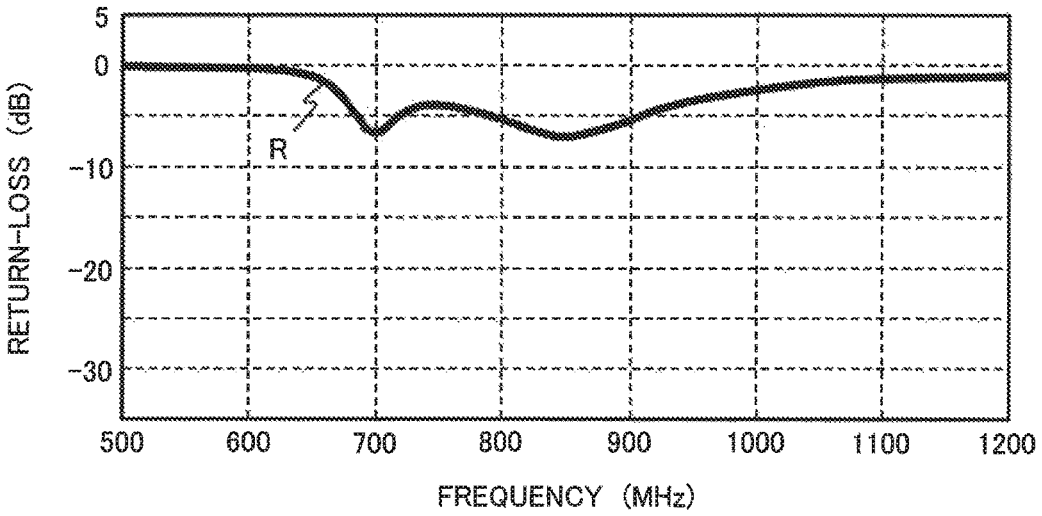
FIG. 5 is a graph showing return-loss characteristics obtained by experiment concerning the antenna device shown in FIG. 3.
Figure 6:
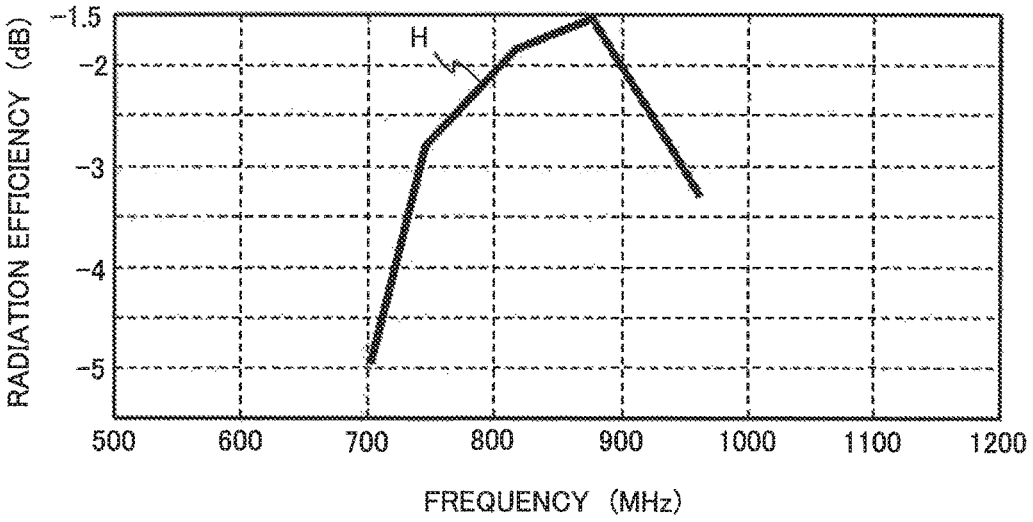
FIG. 6 is a graph showing radiation efficiency characteristics obtained by experiment concerning the antenna device shown in FIG. 3.

FIG. 5 is a graph showing return-loss characteristics of the antenna device 20 according to the second example embodiment. In other words, FIG. 5 is a graph showing the return-loss versus frequency on which the return loss of the antenna device 20 according to the second example embodiment is plotted versus the frequency of the signal supplied from the power supply source 26 to the feed antenna element 21 as a solid line R. FIG. 6 is a graph showing radiation efficiency characteristics of the antenna device 20 according to the second example embodiment. In other words, FIG. 6 is a graph showing the radiation efficiency versus frequency on which the radiation efficiency of the antenna device 20 according to the second example embodiment is plotted versus the frequency of the signal supplied from the power supply source 26 to the feed antenna element 21 as a solid line H.

Figure 8:
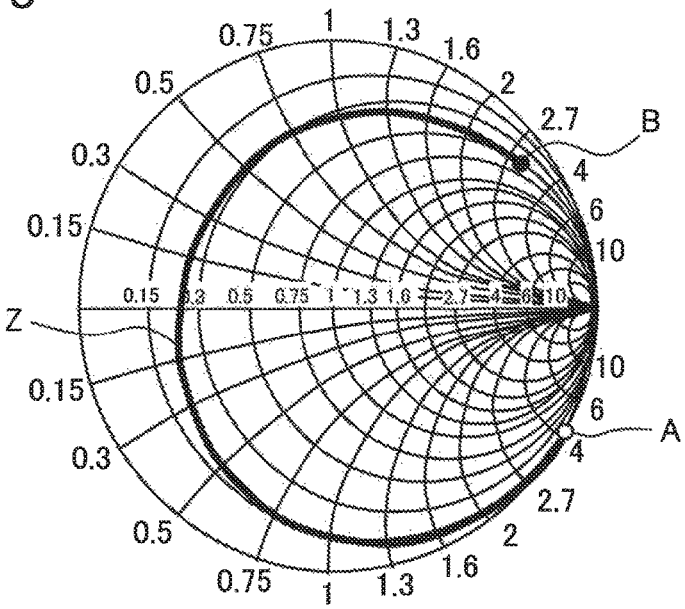
FIG. 8 is a Smith chart showing impedance characteristics obtained by experiment concerning the antenna device shown in FIG. 7.

FIG. 8 is a Smith chart showing impedance characteristics of the antenna device 32 of the comparison example by a solid line Z. In FIG. 8, as explained in FIG. 4, the input impedance at the point of the one end side A on the solid line Z is an input impedance when the frequency of the signal from the power supply source 26 is 500 MHz. The point of one end side A on the solid line Z corresponds to the lowest frequency of the signal. In contrast, the input impedance at the point of other end side B on the solid line Z is an input impedance when the frequency of the signal from the power supply source 26 is 1200 MHz. The point of the other end side B on the solid line Z corresponds to the highest frequency of the signal. Therefore, each point on the solid line Z between the one end side A and the other end side B corresponds to each frequency between the lowest and highest frequencies.

Figure 9:
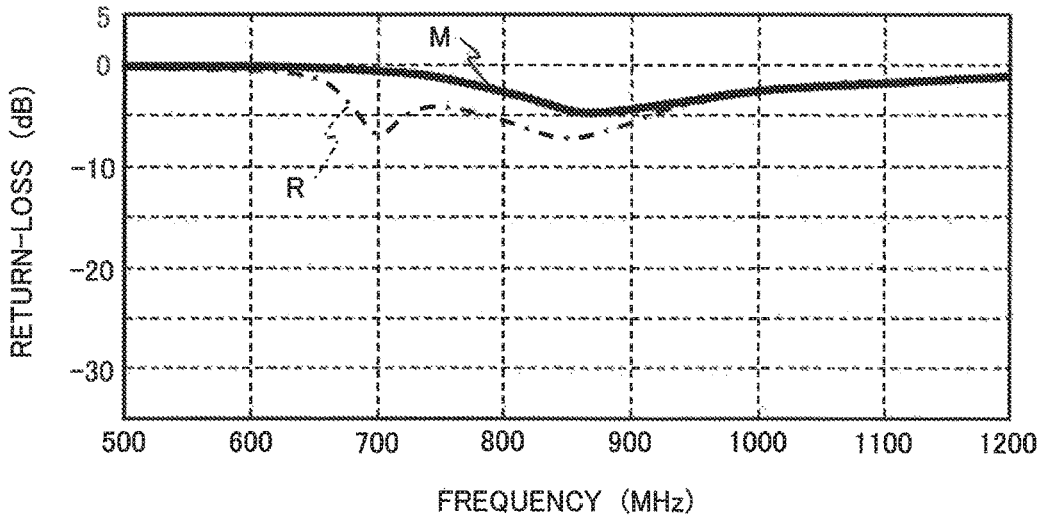
FIG. 9 is a graph showing return-loss characteristics obtained by experiment concerning the antenna device shown in FIG. 7.
Figure 10:
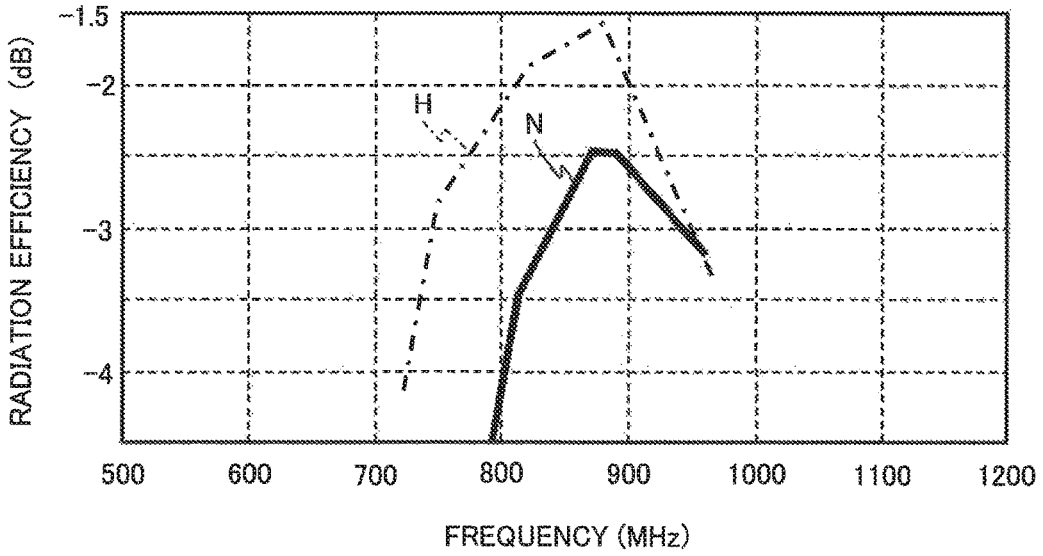
FIG. 10 is a graph showing radiation efficiency characteristics obtained by experiment concerning the antenna device shown in FIG. 7.

FIG. 9 is a graph showing return-loss characteristics of the antenna device 32 of the comparison example by a solid line M. In this FIG. 9, a chain line R represents the return-loss of the antenna device 20 according to the second example embodiment. FIG. 10 is a graph showing radiation efficiency characteristics of the antenna device 32 of the comparison example by a solid line N. In this FIG. 10, a chain line H represents the radiation efficiency of the antenna device 20 according to the second example embodiment.

These experimental results show that impedance characteristics, return-loss characteristics, and radiation efficiency characteristics of the antenna device 20 according to the second example embodiment are improved compared with those of the antenna device 32 of the comparison example. For example, the desired value of the radiation efficiency is 0 dB. Two graphs shown in FIGS. 6 and 10 are compared and the comparison results show that the radiation efficiency of the antenna device 20 according to the second example embodiment is improved overall compared with that of the antenna device 32 of the comparison example. Further, a smaller return-loss value is desirable. Two graphs shown in FIGS. 5 and 9 are compared and the comparison results show that the return-loss of the antenna device 20 according to the second example embodiment is improved overall compared with that of the antenna device 32 of the comparison example. Thus, antenna characteristics such as the radiation efficiency and the like of the antenna device 20 according to the second example embodiment are improved in comparison with those of the antenna device 32 of the comparison example. Therefore, the radio wave transmission/reception state can be improved and the widening of the bandwidth for radio wave transmission/reception can be achieved.

Figure 11:
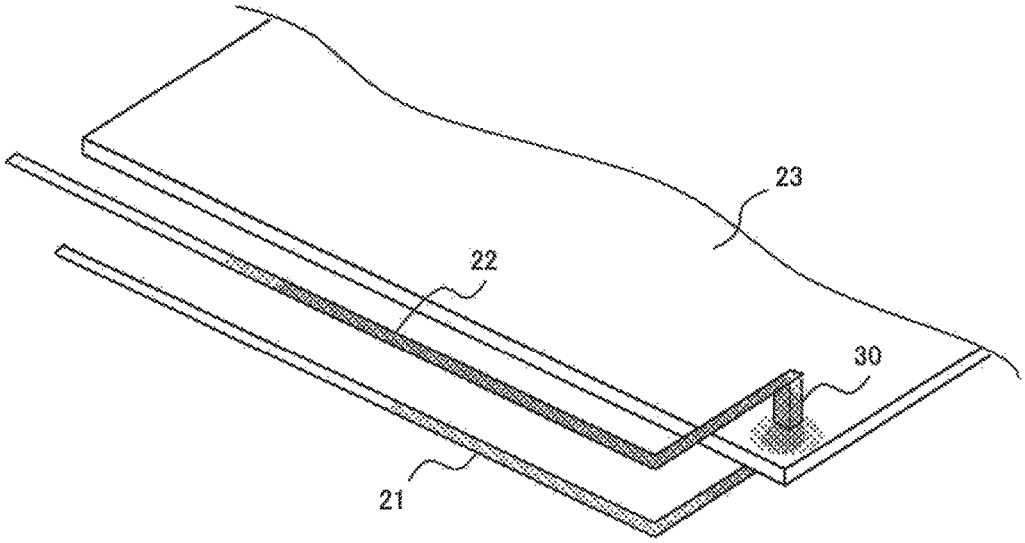
FIG. 11 is a figure illustrating a current distribution when signal with a frequency of 704 MHz is supplied in the antenna device shown in FIG. 3.
Figure 12:
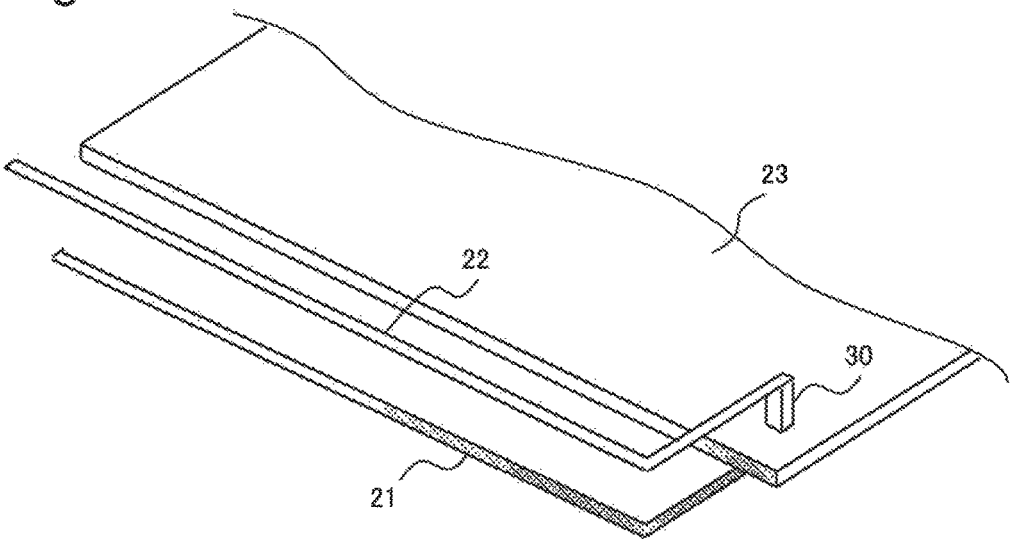
FIG. 12 is a figure illustrating a current distribution when signal with a frequency of 960 MHz is supplied in the antenna device shown in FIG. 3.

The widening of the bandwidth for radio wave transmission/reception in the antenna device 20 according to the second example embodiment can be achieved and this widening can be explained as follows. That is, FIG. 11 is a figure schematically illustrating a current distribution of the feed antenna element 21 and the parasitic antenna element 22 in a case in which signal (electric current) with a frequency of 704 MHz is supplied to the feed antenna element 21 in the antenna device 20 according to the second example embodiment from the power supply source 26. FIG. 12 is a figure schematically illustrating the current distribution of the feed antenna element 21 and the parasitic antenna element 22 in a case in which signal (electric current) with a frequency of 960 MHz is supplied to the feed antenna element 21 in the antenna device 20 according to the second example embodiment from the power supply source 26. In FIG. 11 and FIG. 12, the electric current distribution is depicted by gradation of color. A darker gradation indicates a higher current distribution.

In this second example embodiment, the physical length of the feed antenna element 21 is equal to or approximately equal to that of the parasitic antenna element 22. However, the ground part 28 of the parasitic antenna element 22 is coupled to the coil 30. As a result, the electrical length of the parasitic antenna element 22 is longer than that of the feed antenna element 21 and whereby, the parasitic antenna element 22 has a resonant frequency lower than that of the feed antenna element 21. For this reason, the electric current distribution of the feed antenna element 21 is different from the electric current distribution of the parasitic antenna element 22 with respect to the frequency of the signal flowing in the antenna element. Namely, as shown in FIG. 12, when the frequency of the signal is 960 MHz, the electric current flowing in the feed antenna element 21 is greater than the electric current flowing in the parasitic antenna element 22. In contrast, as shown in FIG. 11, when the frequency of the signal is 704 MHz that is lower than 960 MHz, the electric current flowing in the parasitic antenna element 22 is greater than the electric current flowing in the feed antenna element 21. As a result, the parasitic antenna element 22 improves antenna characteristics in the lower bandwidth from 700 MHz to 800 MHz.

As described above, the antenna device 20 according to this second example embodiment has a configuration in which the shape of the feed antenna element 21 is the same or approximately the same as that of the parasitic antenna element 22 and whereby, an electrically good connection state for wireless communication can be easily obtained. This configuration also contributes to the improvement of antenna characteristics.

Further, in this second example embodiment, the coil 30 is coupled to the ground part 28 of the parasitic antenna element 22. This configuration obtains the following excellent effects in comparison with a case in which the coil is interposed in for example, a central part or an open end side of the parasitic antenna element 22. Namely, because the current density of a ground part side of the parasitic antenna element 22 is high compared with for example, the current density of the central part, the coil 30 has a large influence on the electric characteristics of the parasitic antenna element 22. For this reason, the parasitic antenna element 22 can have the required electric characteristics by the coil 30 even when the coil 30 has a small circuit constant (inductance). In contrast, when the coil is interposed in the central part or the open end of the parasitic antenna element 22, the parasitic antenna element 22 can have the same electrical length as mentioned above when the coil 30 has a large circuit constant unlike a case in which the coil 30 is coupled to the ground part 28. When the circuit constant of the coil is large, the resistance component of the coil is large. Therefore, a problem in which antenna characteristics are degraded may occurs. When the circuit constant of the coil is large, a problem in which a position in which the coil is interposed is regarded as the open end by the frequency of the signal flowing in the parasitic antenna element 22 may occur.

In this second example embodiment, because the coil 30 is coupled to the ground part 28 of the parasitic antenna element 22, the above-mentioned problem does not occur and this configuration can contribute to the improvement of antenna characteristics of the antenna device 20.

Further, in this second example embodiment, a case in which the antenna device 20 is used in the bandwidth from 700 MHz to 800 MHz has been described as an example. However, the antenna device 20 according to this second example embodiment can be applied to an antenna device used in another bandwidth. For example, by adjusting the length of the feed antenna element 21 and the parasitic antenna element 22 and the distance between the feed antenna element 21 and the parasitic antenna element 22 such that the radio wave in the bandwidth set for wireless communication can be transmitted and received, the antenna device 20 can be applied to an antenna device used in the bandwidth set for communication.

Figure 13:
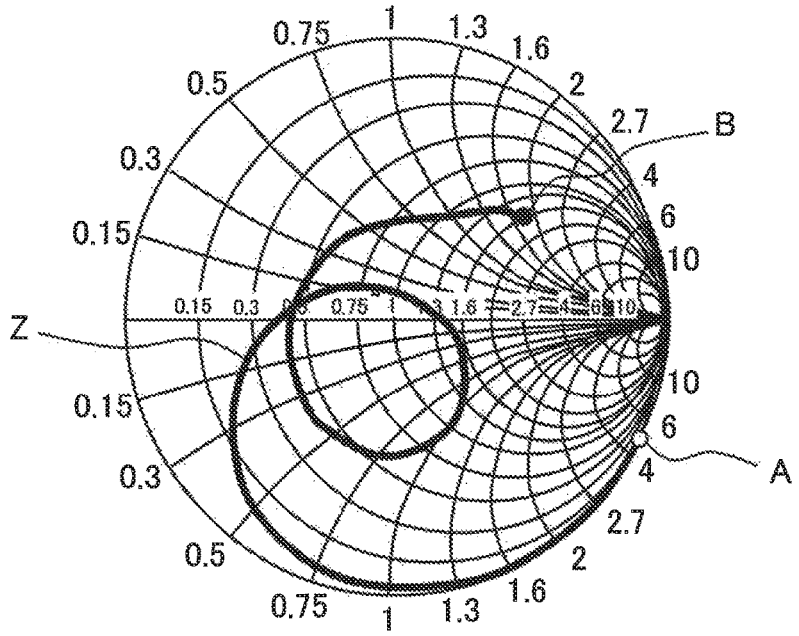
FIG. 13 is a Smith chart showing an example of impedance characteristics of the antenna device according to the second example embodiment which is configured so as to be applied to wireless communication in both 1.5 GHz band and 2.6 GHz band.

FIG. 13 is a Smith chart showing impedance characteristics of result of experiment by the solid line Z with respect to the antenna device 20 of which the length of the feed antenna element 21 and the parasitic antenna element 22, the distance between the feed antenna element 21 and the parasitic antenna element 22, and the circuit constant of the coil 30 are adjusted such that the antenna device 20 can be used in the bandwidth from 1.5 GHz to 2.6 GHz. In FIG. 13, the input impedance at the point of one end side A on the solid line Z is an input impedance when the frequency of the signal from the power supply source 26 is 500 MHz (Megahertz). The point of one end side A on the solid line Z corresponds to the lowest frequency of the signal. In contrast, the input impedance at the point of other end side B on the solid line Z is an input impedance when the frequency of the signal from the power supply source 26 is 3 GHz. The point of the other end side B on the solid line Z corresponds to the highest frequency of the signal. Therefore, each point on the solid line Z between the one end side A and the other end side B corresponds to each frequency between the lowest and highest frequencies.

Further, in the antenna device 20 used in the bandwidth from 1.5 GHz to 2.6 GHz, the inductance of the coil 30 is for example, 6.8 nH. Further, the distance between the feed antenna element 21 and the parasitic antenna element 22 is 2.5 mm.

Figure 14:
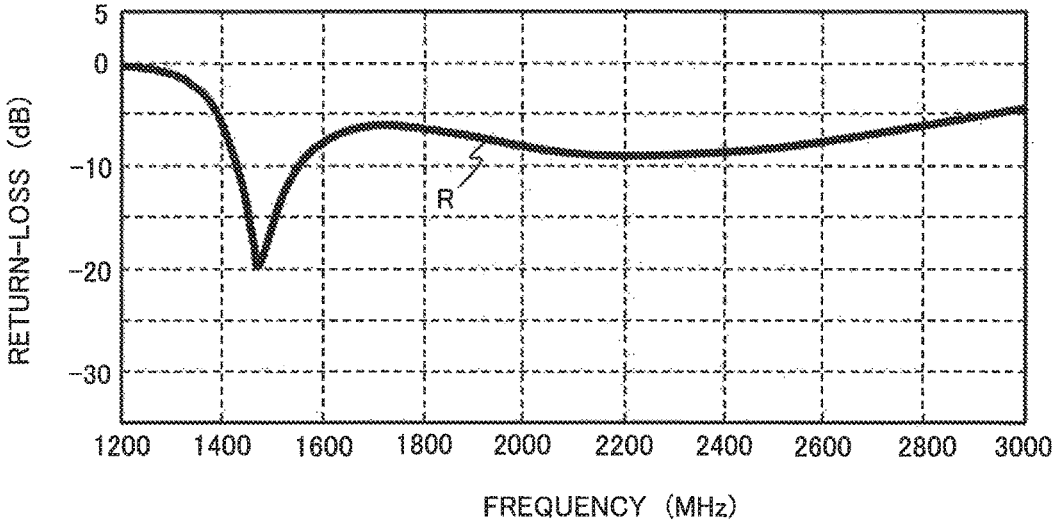
FIG. 14 is a graph showing return-loss characteristics obtained by experiment concerning the antenna device according to the second example embodiment which is configured so as to be applied to wireless communication in both 1.5 GHz band and 2.6 GHz band.
Figure 15:
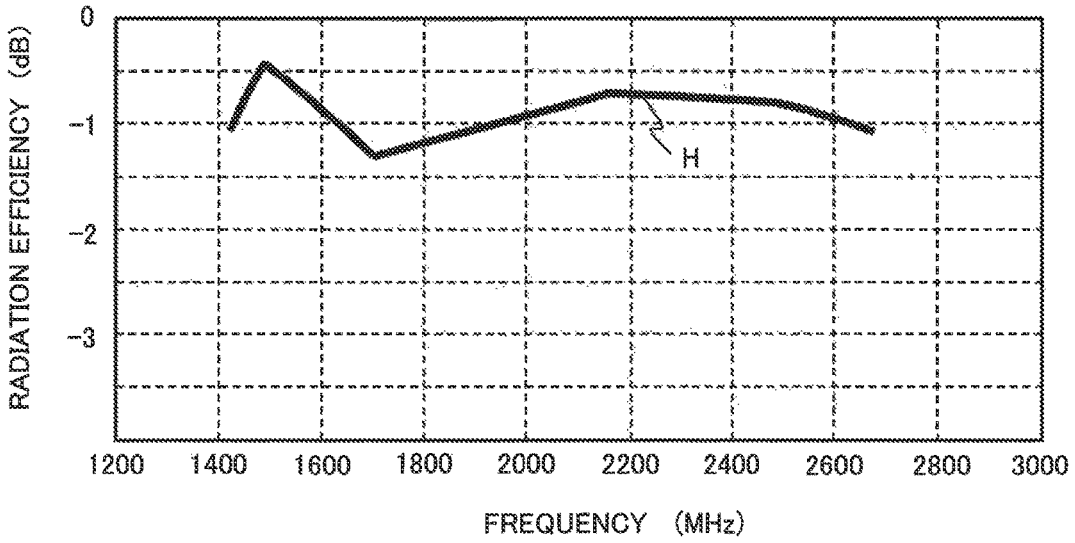
FIG. 15 is a graph showing radiation efficiency characteristics obtained by experiment concerning the antenna device according to the second example embodiment which is configured so as to be applied to wireless communication in both 1.5 GHz band and 2.6 GHz band.

FIG. 14 is a graph showing return-loss characteristics of result of experiment by the solid line R with respect to the antenna device 20 used in the bandwidth from 1.5 GHz to 2.6 GHz. FIG. 15 is a graph showing radiation efficiency characteristics of result of experiment by the solid line H with respect to the antenna device 20 used in the bandwidth from 1.5 GHz to 2.6 GHz.

Figure 16:
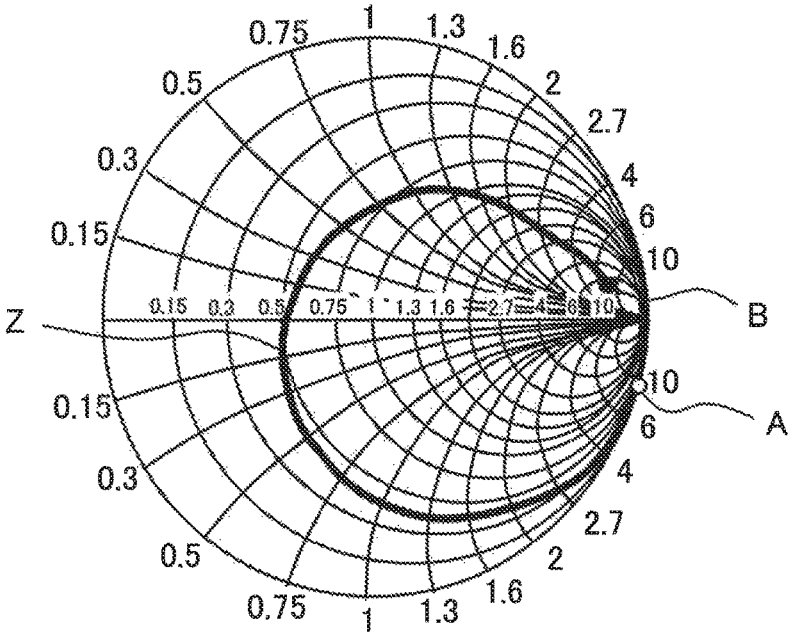
FIG. 16 is a Smith chart showing impedance characteristics obtained by experiment concerning an antenna device of a comparison example 2.
Figure 17:
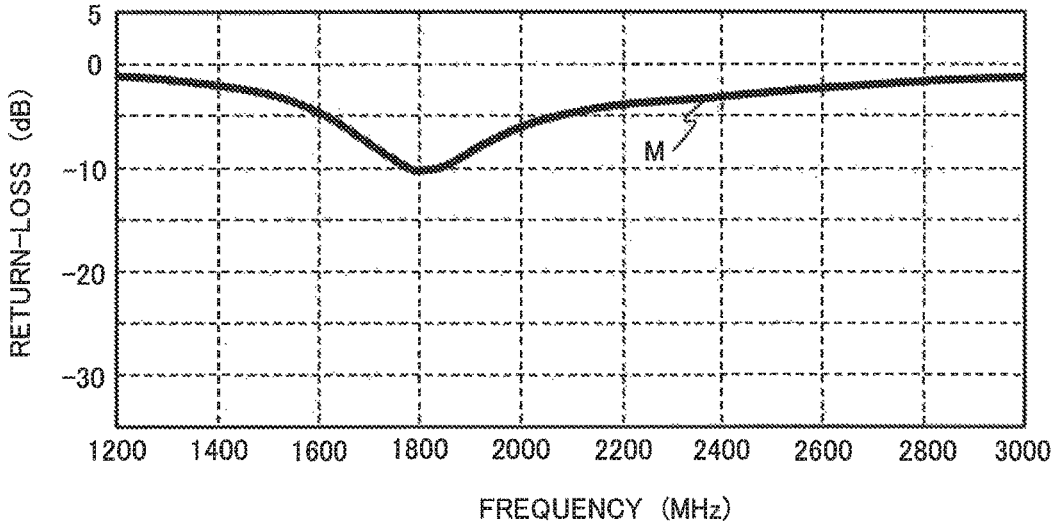
FIG. 17 is a graph showing return-loss characteristics obtained by experiment concerning the antenna device of the comparison example 2.
Figure 18:
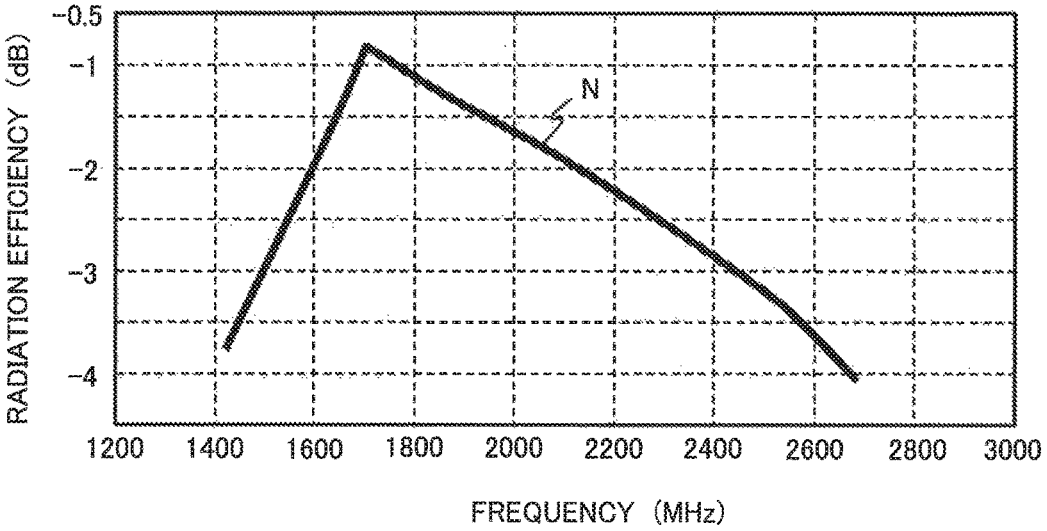
FIG. 18 is a graph showing radiation efficiency characteristics obtained by experiment concerning the antenna device of the comparison example 2.

FIGS. 16 to 18 show antenna characteristics of an antenna device of a comparison example 2 that is compared with the antenna device 20 used in the bandwidth from 1.5 GHz to 2.6 GHz. The antenna device of the comparison example 2 has a configuration of the antenna device 20 used in the bandwidth from 1.5 GHz to 2.6 GHz from which the parasitic antenna element 22 and the coil 30 are omitted.

Namely, FIG. 16 is a Smith chart showing impedance characteristics of result of experiment by the solid line Z with respect to the antenna device of the comparison example 2. In FIG. 16, as explained in FIG. 13, the input impedance at the point of one end side A on the solid line Z is an input impedance when the frequency of the signal from the power supply source 26 is 500 MHz. The point of one end side A on the solid line Z corresponds to the lowest frequency of the signal. In contrast, the input impedance at the point of other end side B on the solid line Z is an input impedance when the frequency of the signal from the power supply source 26 is 3 GHz. The point of the other end side B on the solid line Z corresponds to the highest frequency of the signal. Therefore, each point on the solid line Z between the one end side A and the other end side B corresponds to each frequency between the lowest and highest frequencies. FIG. 17 is a graph showing return-loss characteristics of result of experiment by the solid line M with respect to the antenna device of the comparison example 2. FIG. 18 is a graph showing radiation efficiency characteristics of result of experiment by the solid line N with respect to the antenna device of the comparison example 2.

As shown in FIGS. 13 to 15, antenna characteristics such as the radiation efficiency and the like of the antenna device 20 according to the second example embodiment are better than characteristics of the antenna device of the comparison example 2 that are shown in FIGS. 16 to 18. Namely, antenna characteristics such as the radiation efficiency and the like of the antenna device 20 according to the second example embodiment can be improved.

Third Example Embodiment

A third example embodiment of the present invention will be described below. Further, in the description of this third example embodiment, the same reference numbers are used for the elements having the same function as the second example embodiment. The description of the elements will be omitted appropriately.

In this third example embodiment, the feed antenna element 21 is formed on one surface of the circuit board 23 and the parasitic antenna element 22 is formed on the other surface of the circuit board 23. The configuration of the antenna device 20 according to the third example embodiment is similar to the configuration of the antenna device 20 according to the second example embodiment except to the above mentioned configuration related to a formed location of the feed antenna element 21 and the parasitic antenna element 22.

Figure 19:
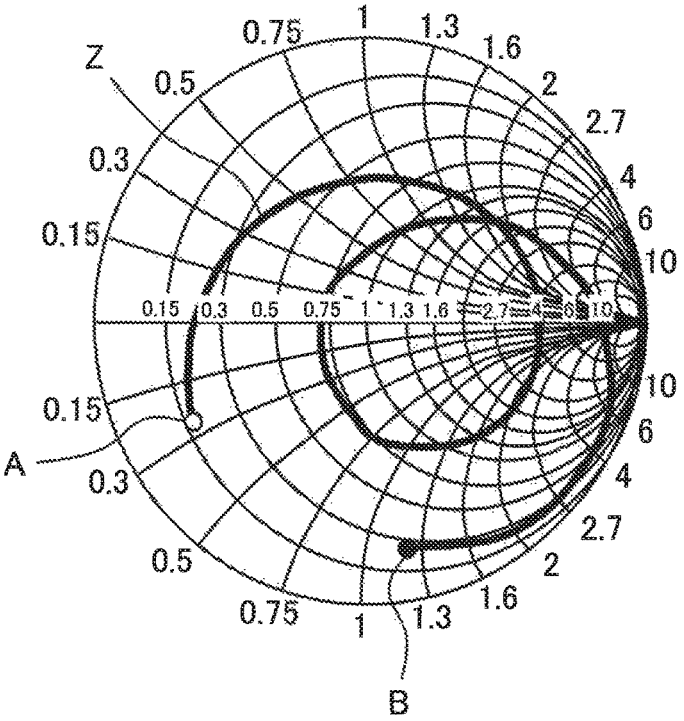
FIG. 19 is a Smith chart showing impedance characteristics obtained by experiment concerning the antenna device according to a third example embodiment of the present invention.
Figure 20:
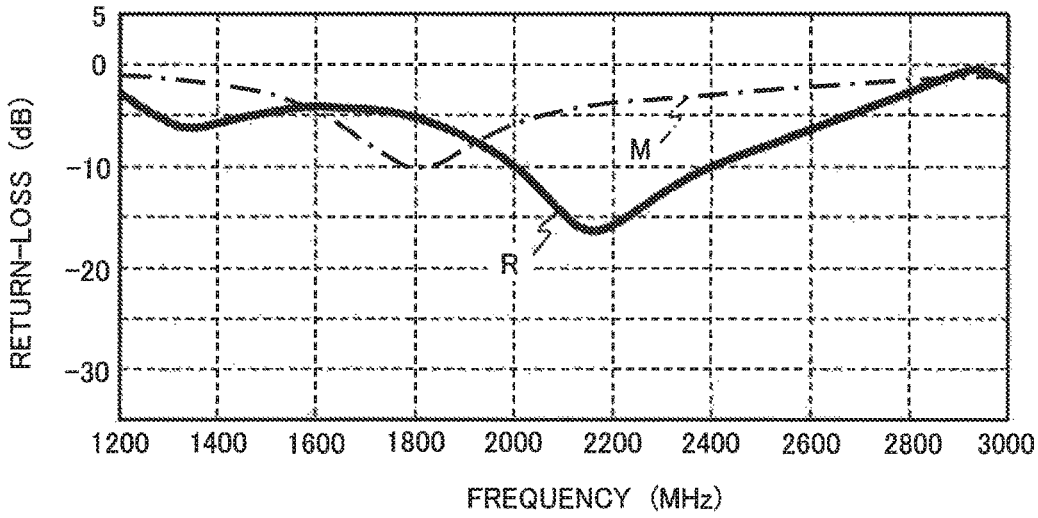
FIG. 20 is a graph showing return-loss characteristics obtained by experiment concerning the antenna device according to the third example embodiment.
Figure 21:
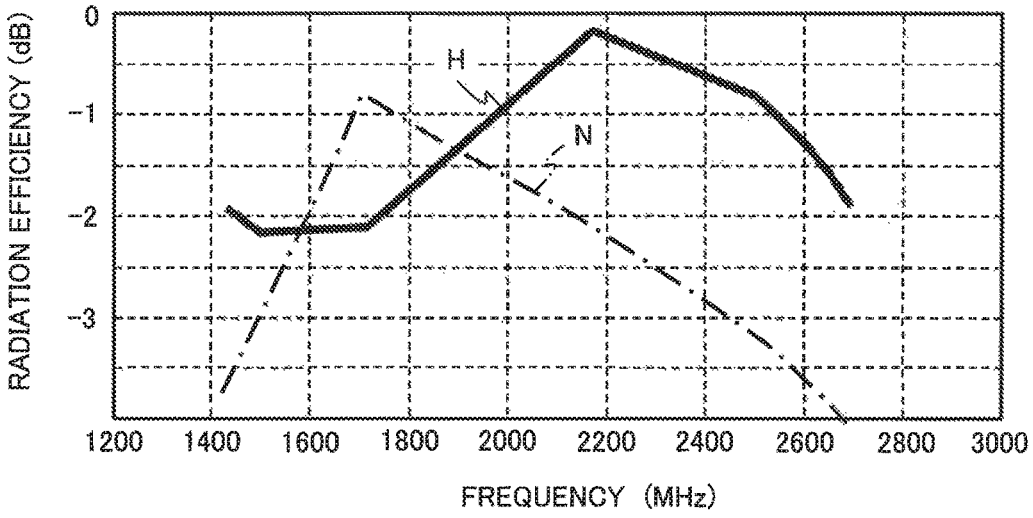
FIG. 21 is a graph showing radiation efficiency characteristics obtained by experiment concerning the antenna device according to the third example embodiment.

The antenna device 20 according to the third example embodiment has effects similar to those of the antenna device 20 according to the second example embodiment. FIG. 19 is a Smith chart showing impedance characteristics of result of experiment by the solid line Z with respect to the antenna device 20 according to the third example embodiment. In the Smith chart shown in FIG. 19, as described in FIG. 13, the input impedance at the point of one end side A on the solid line Z is an input impedance when the frequency of the signal from the power supply source 26 is 500 MHz. The point of one end side A on the solid line Z corresponds to the lowest frequency of the signal. In contrast, the input impedance at the point of other end side B on the solid line Z is an input impedance when the frequency of the signal from the power supply source 26 is 3 GHz. The point of the other end side B on the solid line Z corresponds to the highest frequency of the signal. Therefore, each point on the solid line Z between the one end side A and the other end side B corresponds to each frequency between the lowest and highest frequencies. FIG. 20 is a graph showing return-loss characteristics of result of experiment by the solid line R with respect to the antenna device according to the third example embodiment. In this FIG. 20, a chain line M represents the return-loss of the antenna device of the comparison example 2 shown in FIG. 17. FIG. 21 is a graph showing radiation efficiency characteristics of result of experiment by the solid line H with respect to the antenna device according to the third example embodiment. In this FIG. 21, a chain line N represents the radiation efficiency of the antenna device of the comparison example 2 shown in FIG. 18. Further, in the experiment obtained on the results shown in FIGS. 19 to 21, the size of the circuit board 23 is the same as that of the circuit board used in the experiment described in the second example embodiment. Further, the inductance of the coil 30 is 5.6 nH.

As shown in these experimental results, antenna characteristics such as the radiation efficiency and the like of the antenna device 20 according to the third example embodiment can be improved like the second example embodiment.

Further, because the dielectric substrate 27 is not used in the antenna device 20 according to the third example embodiment, the configuration of the antenna device 20 according to the third example embodiment is simplified than the configuration of the antenna device 20 according to the second example embodiment.

Other Example Embodiments

Figure 22:
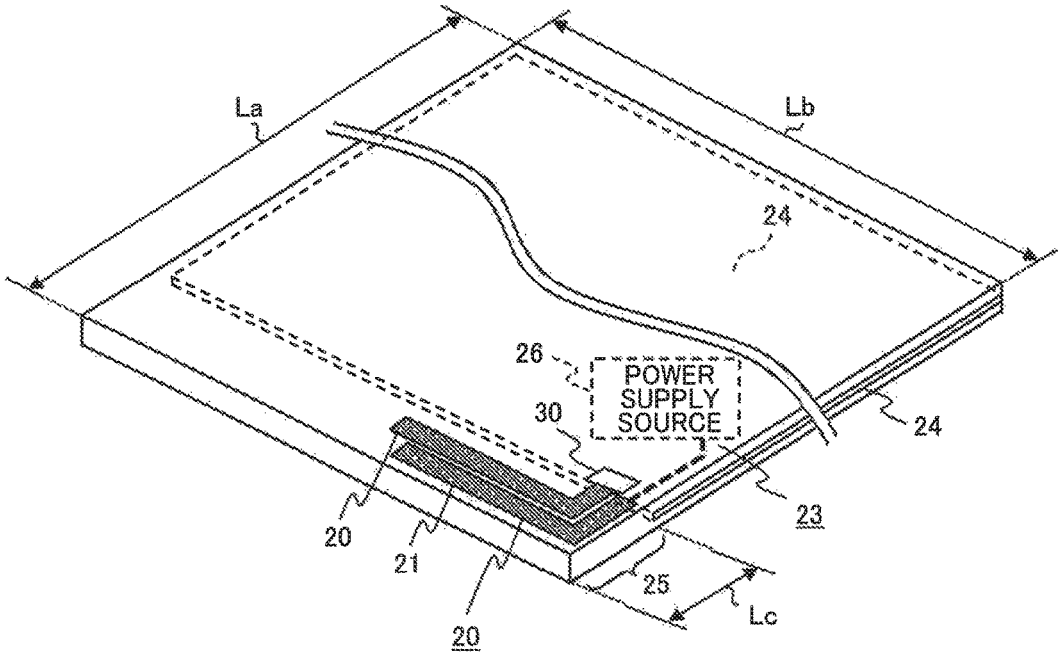
FIG. 22 is a figure illustrating a configuration of an antenna device according to another example embodiment.

Further, this invention is not limited to the first to third example embodiments and various example embodiments can be adopted. For example, in the second and third example embodiments, the feed antenna element 21 and the parasitic antenna element 22 are arranged in parallel with the distance in the thickness direction of the circuit board 23. Alternatively, as shown in FIG. 22, the feed antenna element 21 and the parasitic antenna element 22 may be arranged in parallel via a distance in a surface direction which is along with a surface of the circuit board 23. Even when the configuration shown in FIG. 22 is used, this example embodiment can have effects similar to those of the second and third example embodiments.

Figure 23:
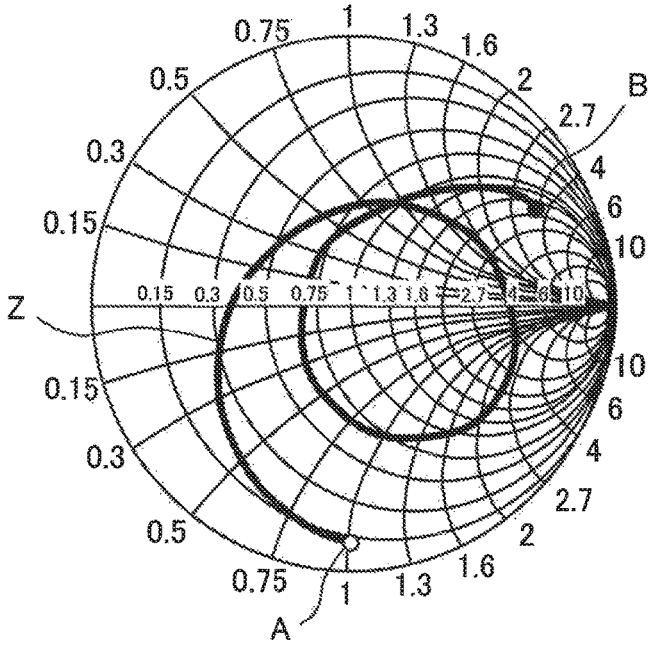
FIG. 23 is a Smith chart showing impedance characteristics obtained by experiment concerning the antenna device shown in FIG. 22.

FIG. 23 is a Smith chart showing impedance characteristics of result of experiment by the solid line Z with respect to the antenna device 20 shown in FIG. 22. In the Smith chart shown in FIG. 23, as described in FIGS. 13 and 19, the input impedance at the point of one end side A on the solid line Z is an input impedance when the frequency of the signal from the power supply source 26 is 500 MHz. The point of one end side A on the solid line Z corresponds to the lowest frequency of the signal. In contrast, the input impedance at the point of other end side B on the solid line Z is an input impedance when the frequency of the signal from the power supply source 26 is 3 GHz. The point of the other end side B on the solid line Z corresponds to the highest frequency of the signal. Therefore, each point on the solid line Z between the one end side A and the other end side B corresponds to each frequency between the lowest and highest frequencies.

Figure 24:
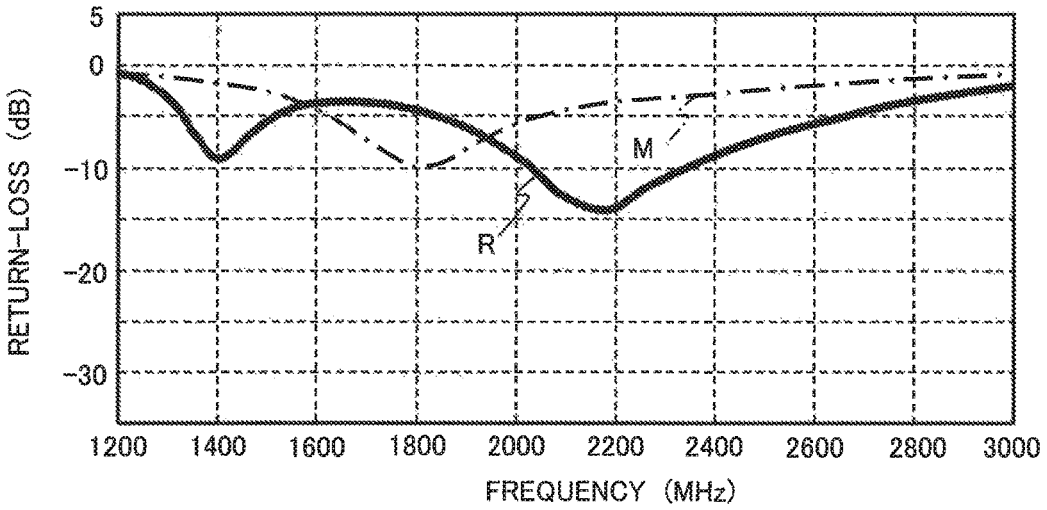
FIG. 24 is a graph showing return-loss characteristics obtained by experiment concerning the antenna device shown in FIG. 22.
Figure 25:
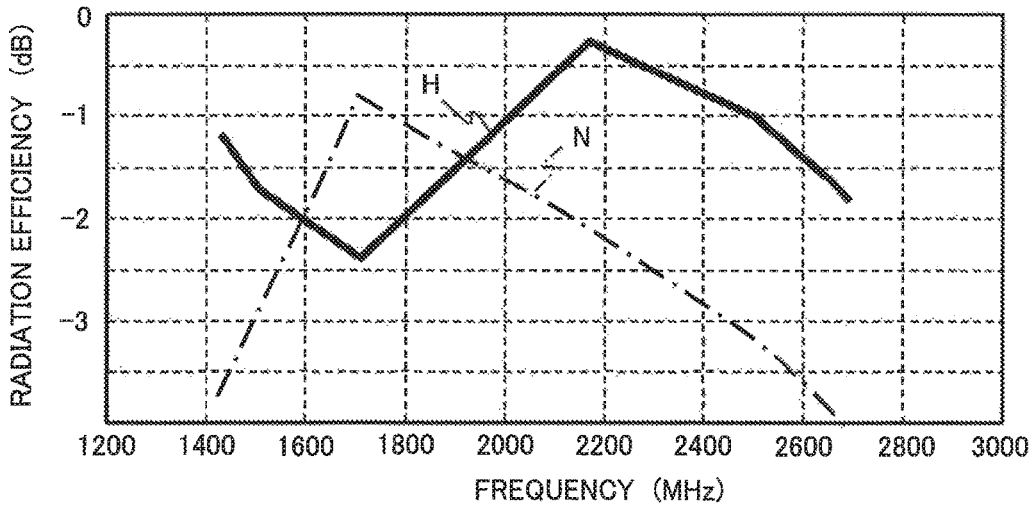
FIG. 25 is a graph showing radiation efficiency characteristics obtained by experiment concerning the antenna device shown in FIG. 22.

FIG. 24 is a graph showing return-loss characteristics of result of experiment by the solid line R with respect to the antenna device shown in FIG. 22. In FIG. 24, the solid line M represents the return-loss characteristics obtained by experiment of the antenna device of the comparison example 2 shown in FIG. 17. FIG. 25 is a graph showing the radiation efficiency characteristics of result of experiment by the solid line H with respect to the antenna device shown in FIG. 22. In FIG. 25, the solid line N represents the radiation efficiency of the antenna device of the comparison example 2 shown in FIG. 18.

Further, in the experiment obtained on the results shown in FIGS. 23 to 25, the size of the circuit board 23 used in this experiment is the same as the size of the circuit board used in the experiment described in the second and third example embodiments. Further, the inductance of the coil 30 used in this experiment is 5.6 nH. As shown in these experimental results, the antenna characteristics of the antenna device 20 shown in FIG. 22 can be improved like the second and third example embodiments.

While the invention has been particularly shown and described with reference to exemplary embodiments thereof, the invention is not limited to these embodiments. It will be understood by those of ordinary skill in the art that various changes in form and details may be made therein without departing from the spirit and scope of the present invention as defined by the claims.

This application is based upon and claims the benefit of priority from Japanese patent application No. 2014-131195, filed on Jun. 26, 2014, the disclosure of which is incorporated herein in its entirety by reference.

REFERENCE SIGNS LIST

1 and 20 antenna device
2 and 21 feed antenna element
3 and 22 parasitic antenna element
4 inductive element
6 and 23 circuit board
7 and 26 power supply source
8 and 24 ground layer
12 wireless communication device
30 coil

What is claimed is:

1. An antenna device comprising:

a feed antenna element that is coupled electrically to a power supply source which supplies signal used in wireless communication; and a parasitic antenna element that is coupled electrically to the feed antenna element, wherein the feed antenna element is configured in a circuit board equipped with the power supply source, and the parasitic antenna element includes a ground part, and the ground part is coupled electrically to a ground layer via an inductive element having inductivity, the ground layer has a reference potential and is formed in the circuit board, the inductive element has a circuit constant which adjusts a resonant frequency of the parasitic antenna element such that the resonant frequency of the parasitic antenna element is lower than a resonant frequency of the feed antenna element and widens a bandwidth of return-loss characteristics and radiation efficiency characteristics in wireless communication by resonance of the parasitic antenna element and the feed antenna element, a shape and size of the feed antenna element is at least substantially the same as a shape and size of the parasitic antenna element.

2. The antenna device according to claim 1, wherein the feed antenna element and the parasitic antenna element are arranged in parallel via a distance in a thickness direction which is along with thickness of the circuit board.

3. The antenna device according to claim 1, wherein the feed antenna element and the parasitic antenna element are arranged in parallel via a distance in a surface direction which is along with a surface of the circuit board.

4. A wireless communication device comprising:

a power supply source that supplies signal used in wireless communication;

a circuit board that includes the power supply source; and an antenna device that includes:

a feed antenna element that is coupled electrically to the power supply source; and a parasitic antenna element that is coupled electrically to the feed antenna element, wherein the feed antenna element is configured in the circuit board equipped with the power supply source, and the parasitic antenna element includes a ground part, and the ground part is coupled electrically to a ground layer via an inductive element having inductivity, the ground layer has a reference potential and is formed in the circuit board, the inductive element has a circuit constant which adjusts a resonant frequency of the parasitic antenna element such that the resonant frequency of the parasitic antenna element is lower than a resonant frequency of the feed antenna element and widens a bandwidth of return-loss characteristics and radiation efficiency characteristics in wireless communication by resonance of the parasitic antenna element and the feed antenna element, a shape and size of the feed antenna element is at least substantially the same as a shape and size of the parasitic antenna element.

5. A bandwidth adjustment method comprising:

configuring a parasitic antenna element in a circuit board in which a feed antenna element is configured, the feed antenna element being coupled electrically to a power supply source which supplies signal used in wireless communication, the parasitic antenna element being coupled electrically to the feed antenna element, a shape and size of the feed antenna element is is at least substantially the same as a shape and size of the parasitic antenna element;

electrically connecting a connection part of the parasitic antenna element to a ground layer via an inductive element having inductivity, the ground layer having a reference potential and being formed in the circuit board; and adjusting a bandwidth of wireless communication by resonance of the parasitic antenna element and the feed antenna element to widen the bandwidth of return-loss characteristics and radiation efficiency characteristics in wireless communication by adjusting an inductive reactance of being a circuit constant of the inductive element such that the resonant frequency of the parasitic antenna element is lower than a resonant frequency of the feed antenna element.

* * * * *